US006330425B1

(12) United States Patent
Ohuchi et al.

(10) Patent No.: US 6,330,425 B1
(45) Date of Patent: Dec. 11, 2001

(54) DOUBLE-SURFACE PRINTING APPARATUS

(75) Inventors: Yoshio Ohuchi, Tokai-mura; Akira Shimizu, Hitachinaka; Nobuaki Fukasawa; Michio Sumiyoshi, both of Hitachi; Satoshi Narita, Hitachiota; Kiminori Takada, Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/558,041

(22) Filed: Apr. 26, 2000

(30) Foreign Application Priority Data

May 31, 1999 (JP) ..... 11-152596

(51) Int. Cl.[7] ..... G03G 15/00
(52) U.S. Cl. ..... 399/401; 271/188
(58) Field of Search ..... 399/401, 402, 399/406, 107; 271/161, 188, 209, 902, 225

(56) References Cited

U.S. PATENT DOCUMENTS 4,990,965 * 2/1991 Kiya ..... 399/402
5,091,754 * 2/1992 Abe et al. ..... 271/188 X
5,839,032 * 11/1998 Yasui et al. ..... 399/401 X
5,937,260 * 8/1999 Taninaka et al. ..... 399/401
5,974,298 * 10/1999 Urban et al. ..... 399/401

FOREIGN PATENT DOCUMENTS 60-101551 * 6/1985 (JP) .....
61-073965 * 4/1986 (JP) .....
63-087465 * 4/1988 (JP) .....

* cited by examiner

*Primary Examiner*—Sophia S. Chen
(74) *Attorney, Agent, or Firm*—Antonelli, Terry, Stout & Kraus, LLP

(57) ABSTRACT

A double-surface printing apparatus, which is small-sized and has a simple construction to make it impossible to take out a sheet, of which one surface has been subjected to printing, from outside. The apparatus includes a paper discharge tray, to which sheets having been subjected to printing are discharged; a sheet reversing mechanism including a reversal/temporary storage unit for guiding a sheet in a direction different from a discharge direction toward the paper discharge tray, once exposing the sheet outside of the apparatus, and rotating conveying rollers in an opposite direction to thereby reverse the sheet; and a protective cover, which covers the sheet conveyed to the reversal/temporary storage unit so that a sheet, of which one-surface has been subjected to printing, cannot be taken out from outside.

3 Claims, 7 Drawing Sheets

DOUBLE-SURFACE PRINTING APPARATUS

BACKGROUND OF THE INVENTION

1. Field of the Invention

The invention relates to a double-surface printing type printing apparatus, in which a sheet with one surface thereof having been subjected to printing is once reversed, and then the other surface of the sheet is subjected to printing to finish a double-surface printing, and more particularly, to a double-surface printing apparatus, in which a sheet having experienced only one-surface printing and not having experienced any double-surface printing is prevented from being inadvertently taken out.

2. Description of the Related Art

With the miniaturization and cost reduction of a host personal computer, a printing apparatus, in particular, a so-called page printer has been promoted to be reduced in size and cost. Many of the printing apparatuses conventionally used as a printing apparatus and having a function of double-surface printing are mostly expensive large-sized printing apparatuses. Further, to solve this issue, the inventions described in Japanese Patent Unexamined Publication Nos. 255476/1990 and 215646/1990 have been proposed, in which a portion above a paper discharge tray surface in a printing apparatus is used for guiding a sheet to a sheet conveyance path for feeding the same sheet again into a apparatus body.

However, since a portion of a sheet having a first surface (front surface) after printing temporarily comes out of the apparatus, it is feared that some short-tempered users would pull out the sheet before the sheet is put in a sheet reverse conveying condition in order that the sheet be conveyed into the printing apparatus for printing of a second surface (back surface). Therefore, the apparatus is required to be provided with additional abnormality detecting means for detecting the sheet being taken away midway, and several complex arrangements for issuing to a host side a demand to the effect that printing data be fed again.

In addition, if a cover is mounted on a paper discharge tray surface so as to prevent a sheet from being inadvertently taken out during printing, the cover must be opened every time a sheet printed is to be removed, which makes handling inconvenient.

To solve the problem, the invention disclosed in, for example, Japanese Patent Unexamined Publication No. 157212/1998 has been proposed. The proposed invention provides a double-surface printing apparatus, in which in performing a double-surface printing processing, at least a portion of a sheet during the processing is once exposed to a conveyance path accessible from outside the apparatus, and the sheet is again conveyed into the apparatus to be subjected to the double-surface printing processing. The apparatus comprises reconveyance discriminating means for discriminating whether or not the sheet should be reconveyed when the sheet is exposed to the conveyance path, and alarming means for giving an alarm to an operator when the reconveyance discriminating means identifies the exposed sheet being an object of reconveyance. The alarming means includes protective means, which covers the conveyance path to thereby inhibit the exposed sheet from being touched.

Also, an image forming apparatus capable of double-surface printing, disclosed in Japanese Patent Unexamined Publication No. 140733/1995, is also known. The apparatus of the invention comprises feed means provided in a substantially horizontal direction, discharge/load means disposed above the feed means, image forming means and fixing means provided in a conveyance path in a substantially vertical direction, which path connects between the feed means and the discharge/load means, first switching means provided immediately after the fixing means, for switching the sheet to a direction different from a direction toward the discharge/load means, a reconveyance path for reversing the sheet, of which direction has been switched by the first switching means, guiding the sheet substantially vertically downwardly, and guiding the sheet downward below the feed means, reversal conveying means for reversing and conveying the sheet being conveyed along the reconveyance path, and second switching means for guiding the sheet, which is reversed and conveyed by the reversal conveying means, again toward the image forming means. With such arrangement, at the time of double-surface image formation, the first switching means conducts a sheet, of which one surface is formed with an image, to the reconveyance path, and the sheet conveyed along the reconveyance path is reversed and conveyed by the reversal conveying means, and is conducted again to the image forming means by the second switching means for double-surface image formation. In this invention, a sheet entering the reconveyance path is reversed for printing on both surfaces without being exposed to outside of the apparatus, and discharged, so that subsequently discharged, so that there is no fear that a sheet is taken out before the completion of image formation on both surfaces.

Incidentally, with the invention disclosed in the Japanese Patent Unexamined Publication No. 157212/1998, in the event of double-surface printing being specified, a FU paper discharge tray, which serves as a paper discharge tray when a printed surface of a sheet turns upward, is turned to a position to lie above a FD paper discharge tray, which discharge sheets with a surface printed thereof turned downward, to lie above a sheet, which is switched back for reversal. In this case, sheets having been subjected to double-surface printing are discharged to the FD paper discharge tray, and the FU paper discharge tray lies the sheets, while it is possible to take out the sheets by gaining access thereto from between the FD paper discharge tray and the FU paper discharge tray. Therefore, there is the possibility that a user may take out a sheet exposed for reversal with the intention of taking out a sheet having been subjected to printing.

Further, the above Japanese Patent Unexamined Publication No. 140733/1995 discloses the image forming apparatus, in which the reconveyance path disposed in an outer housing is constructed such that a sheet positioned in the reconveyance path cannot be taken out from outside. In the image forming apparatus, a reversal path is disposed in a lower portion of the housing, while it is disposed in an embodiment below a position where a sheet feed cassette is arranged, or disposed on a side of the housing to be in parallel to the reconveyance path. However, if the reversal path is disposed in the lower portion of, or on the side of the housing, the conveyance path becomes lengthy, which cannot but make the apparatus large in size, and cannot meet the demand for miniaturization.

Furthermore, with the image forming apparatus of this type, curl of a sheet is sometimes problematic. Curl of a sheet is caused by the application of heating or pressurizing by rollers of a fixing unit, such that a sheet passed through the fixing unit is normally discharged in a curled condition. There is a fear that when a sheet is taken into a reversal conveying section for printing on a second surface of the sheet, it may cause jamming wrapping in its leading end, which goes ahead, and may cause sheet jamming in the conveyance path after the reversal dependent on the degree of such curl.

SUMMARY OF THE INVENTION

In view of the above, the invention has been thought of, and has its first object to provide a double-surface printing apparatus, which is small-sized and has a simple construction to make it impossible to take out a sheet, of which one surface has been subjected to printing, from outside.

Also, a second object of the invention is to provide an inexpensive double-surface printing apparatus, which suffices to be simply added as a unit to existing printing apparatuses to enable double-surface printing.

Further, a third object of the invention is to provide an inexpensive double-surface printing apparatus, which eliminates sheet jamming attributable to curl of a sheet.

To attain the above-described object, the invention provides a double-surface printing apparatus comprising a paper discharge tray for discharging a sheet after printing, and a sheet reversing mechanism including a reversal/temporary storage unit for conducting a sheet in a direction different from a discharge direction toward the paper discharge tray, once exposing the sheet outside of the apparatus, and subsequently rotating a conveying roller in a reverse direction to reverse the sheet, and a protector, which covers the sheet conveyed to the reversal/temporary storage unit.

In this case, the reversal path for the reversal /temporary storage unit and a direction, in which a sheet is guided to the paper discharge tray, are set in opposite directions, in other words, reverse directions, which makes it easy to take out sheets discharged. Further, the reversal path is provided on a top surface of the apparatus, and as the protector, and the protective means can employ, for example, a protective cover for covering the reversal/temporary storage unit from a top surface side of the apparatus, or a sheet guide for covering a curved path portion of the reversal/temporary storage unit. Further, installed outside a body of the double-surface printing apparatus are the sheet reversing mechanism, and a sheet conveying mechanism including a conveyance path, through which a sheet reversed by the sheet reversing mechanism is again conveyed to an image forming side. With the arrangement, a sheet feed cassette for receiving sheets being printed is also constructed to be included in the sheet conveying mechanism, which prevents generation of a wasteful space.

Meanwhile, the sheet reversing mechanism is provided with curl removing means for correcting a curl applied to the sheet in the printing process to prevent a sheet jam from being caused. The curl removing means comprises, for example, the conveying rollers provided in the sheet reversing mechanism and the reversal/temporary storage unit. In this case, the reversal/temporary storage unit comprises a curved portion formed to have a curvature opposite to a direction, in which a sheet is curled, and the conveying rollers comprise a pair of first conveying rollers, and a pair of second conveying rollers. The pair of first conveying rollers are provided in the curved portion, the pair of second conveying rollers are provided to be positioned downstream of the pair of first conveying rollers when a sheet enters, and a peripheral speed of the pair of second conveying rollers is set to be higher than that of the pair of first conveying rollers. Therefore, curl applied to a sheet, when a sheet is reversed and passes through the fixing unit, is bent in a direction opposite to the curl, by which it is possible to remove the curl forcibly.

As described above, in a first aspect of the invention, protective means is provided to cover a sheet having been conveyed to the reversal/temporary storage unit, thus enabling preventing an operator from inadvertently taking out a sheet, of which one surface has been printed. In this case, it suffices to cover a sheet, so that it is possible to realize a small-size double-surface printing apparatus with a simple construction.

In a second aspect of the invention, directions, in which a sheet is guided toward the reversal/temporary storage unit and toward the paper discharge tray, are set to be opposite to each other. Therefore, it can be discriminated whether a sheet concerned has been subjected to printing or has been subjected at one surface thereof to printing and is to be subjected at the other surface thereof to printing, and so the sheet is not removed erroneously.

In a third aspect of the invention, the reversal/temporary storage unit is provided on a top of the apparatus, and the protective means comprises a protective cover, which covers the entire region of the reversal/temporary storage unit. Therefore, a sheet cannot be touched from outside, and so it is possible to positively prevent a sheet with one surface printed from being taken out.

In a fourth aspect of the invention, the reversal/temporary storage unit is provided on a top of the apparatus, and the protective means comprises a sheet guide, which covers a curved path portion of the reversal/temporary storage unit. So, it can be judged that a sheet is to be subjected at the other surface thereof to printing, and thus the sheet will not be taken out erroneously.

In a fifth aspect of the invention, the sheet reversing mechanism, and a sheet conveying mechanism including a conveyance path and for conveying a sheet reversed by the sheet reversing mechanism, again to an image forming side are disposed outside a body of the double-surface printing apparatus. Thus an inexpensive double-surface printing apparatus capable of performing double-surface printing can be provided by adding the mechanism as a unit to existing printing apparatuses.

In a sixth aspect of the invention, a sheet feed cassette for accommodating sheets being printed is provided in the sheet conveying mechanism. So, it is possible to implement double-surface printing and additional installation of sheet feed stages simultaneously, so that convenience in use can be improved.

In a seventh aspect of the invention, curl removing means is provided in the sheet reversing mechanism for correcting a curl applied to a sheet during a printing process. Therefore, it is possible in the double-surface printing process to prevent generation of jamming of sheets due to curl in sheets.

In an eighth aspect of the invention, the curl removing means comprises conveying rollers and the reversal/temporary storage unit provided in the sheet reversing mechanism. So, by making use of the conveying mechanism of the sheet reversing mechanism, it becomes possible to remove a curl of a sheet, and to provide a double-surface printing apparatus, which is clear of an increase in cost and excellent in convenience of use.

In a ninth aspect of the invention, the reversal/temporary storage unit includes a curved portion formed to have a curvature opposite to that of a direction, in which a sheet is curled, and the conveying rollers include at least a pair of first conveying rollers provided in the curved portion, and a pair of second conveying rollers positioned downstream of the pair of first conveying rollers at the time of entry of a sheet, and wherein a peripheral speed of the pair of second conveying rollers is set to be higher than that of the pair of first conveying rollers. Thus it is possible for the curved portion of the reversal/temporary storage unit to surely impart tension to a sheet in an opposite direction to a direction, along which the sheet assumes a curl, so that a curl of a sheet can be simply corrected.

DETAILED DESCRIPTION OF THE PREFERRED EMBODIMENTS

An embodiment of the invention will be described hereinafter with reference to the drawings.

Figure 1:
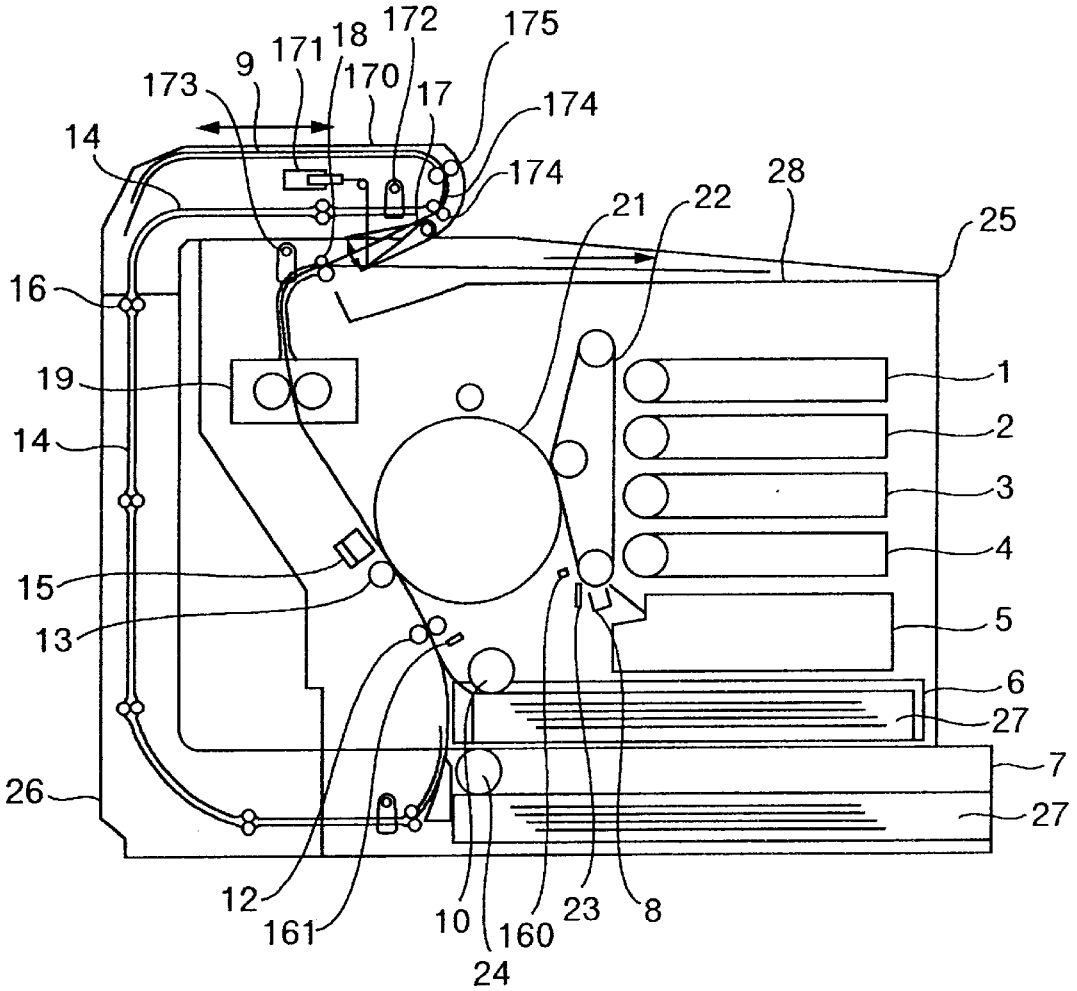
FIG. 1 is a schematic view showing the constitution of a printing apparatus according to an embodiment of the invention.
Figure 2:
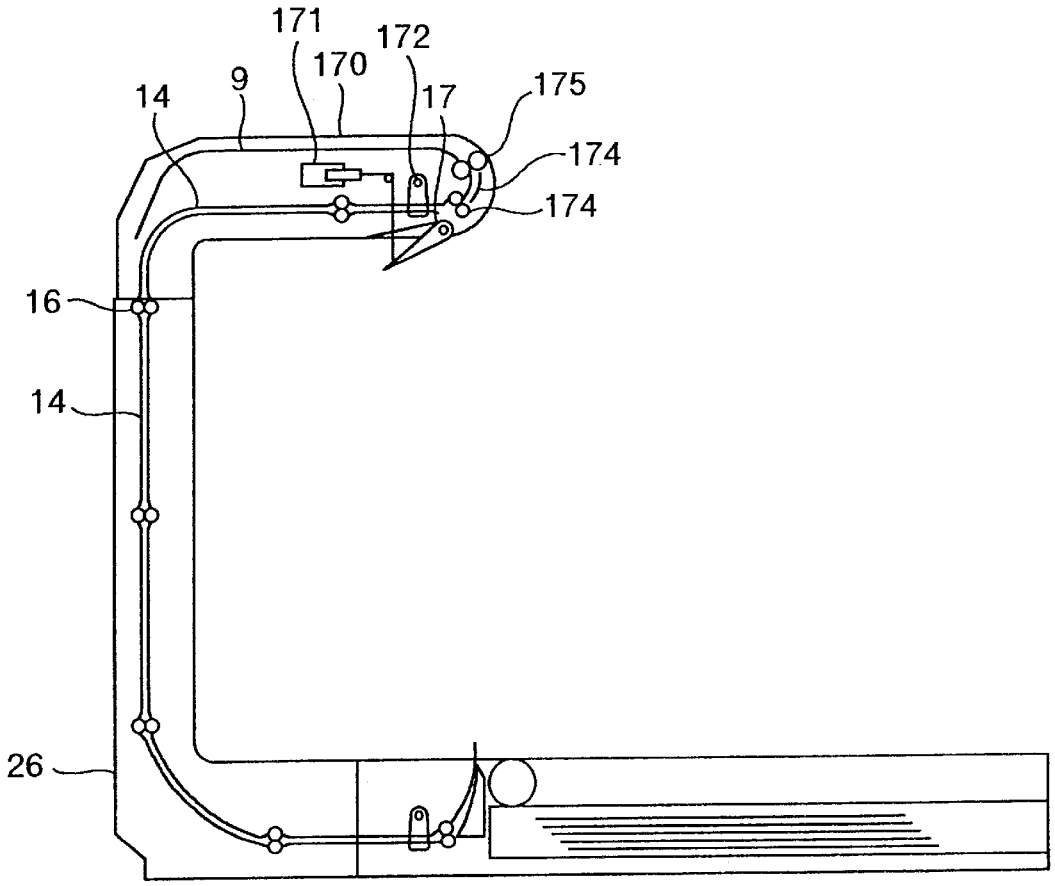
FIG. 2 is a schematic view showing a reversal sheet feeding device of FIG. 1 in separation.

FIG. 1 is a schematic view showing the constitution of a printing apparatus according to an embodiment of the invention. As shown in FIG. 1, a printing apparatus body 25 mainly comprises developers 1 to 4 provided for four colors; an optical unit 5 provided below the developers 1 to 4; a photosensitive belt 22 provided in a position where it faces developing rollers of the respective developers 1 to 4; a charger 8 for charging the photosensitive belt 22 with electricity; a transfer drum 21, to which an image is transferred when it contacts with the photosensitive belt 22; a first sheet cassette 6 provided below the optical unit 5; resist rollers 12 for conveying a sheet 27, which is conducted from the sheet cassette 6 or a sheet guide 14 constituting a reconveyance path, in timed relationship with an image on the transfer drum 21; a transfer roller 13 for transferring to the sheet 27 the image on the transfer drum 21; an electricity eraser 15 for peeling the sheet 27, to which the image has been transferred, from the transfer drum 21; a fixing unit 19 for fixing the transferred image to the sheet 27; and paper discharge rollers 18 for discharging the sheet 27, on which the image is fixed, to a paper discharge tray 28 or to the side of a reversal/temporary storage unit 9. Moreover, a reversal sheet feeding device 26 is shown as being in separated state in FIG. 2, which includes the reversal/temporary storage unit 9, the sheet guide 14 and a second sheet feed cassette 7, and is mounted on the left side of and below a body of the printing apparatus 25 as seen in FIG. 1 to constitute a double-surface printing apparatus.

Figure 3:
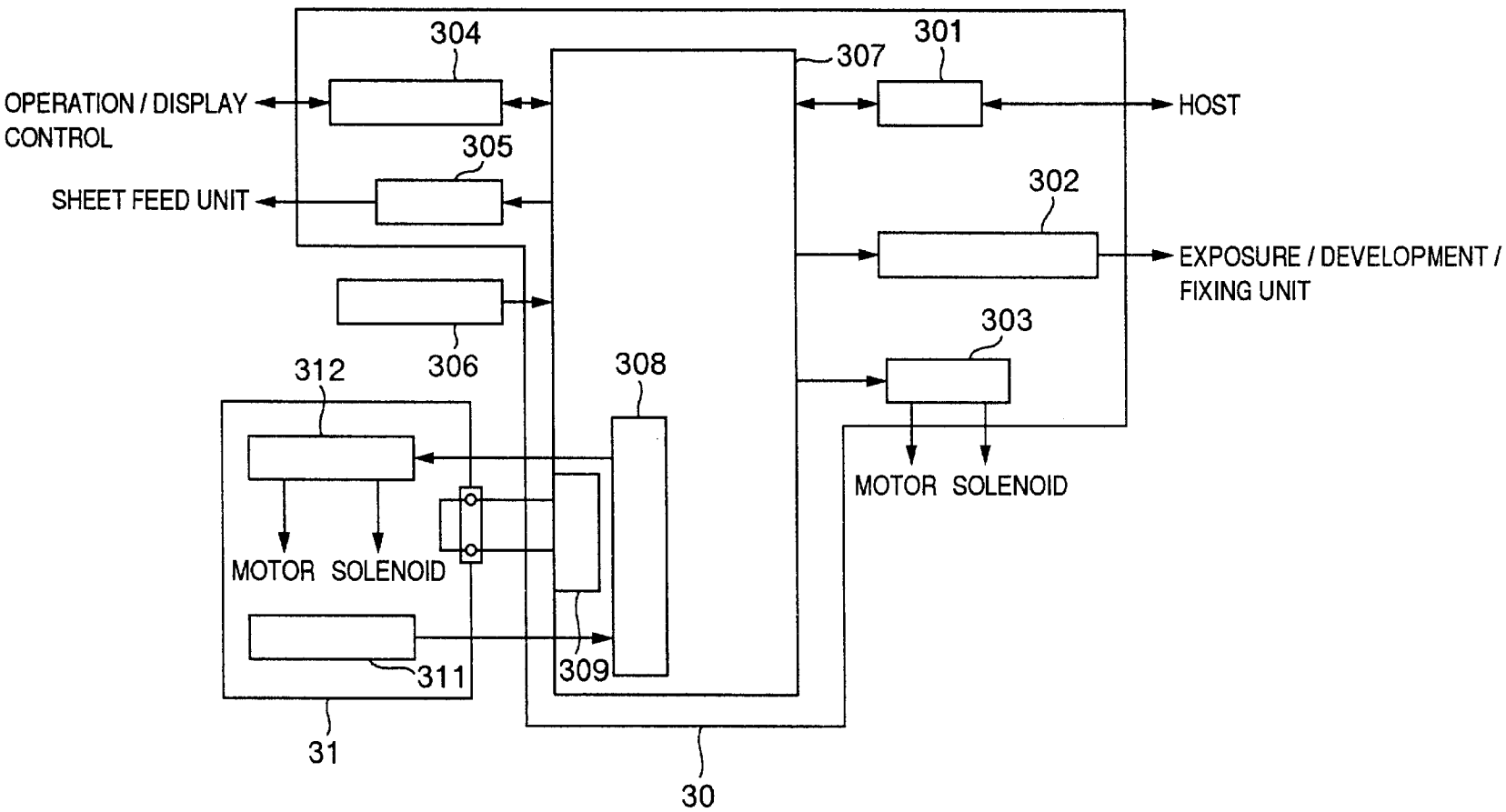
FIG. 3 is a control block diagram showing the electric constitution of a double-surface printing apparatus according to the embodiment.

FIG. 3 is a control block diagram showing the electric constitution of the double-surface printing apparatus according to the embodiment. The control block of the double-surface printing apparatus according to the embodiment is roughly composed of two blocks including a control unit 30 for the printing apparatus body and a control unit 31 for the reversal sheet feeding device. The control unit 30 for the printing apparatus body is mainly composed of a sequence control unit 307 and a sheet reversal control unit 308, and further includes an I/F unit 301 for exchanging data with a host, an exposure/development/fixing control unit 302 for controlling the optical unit 5, the developers 1 to 4, and the fixing unit 19, a drive control unit 303 for power sources such as a motor and a solenoid, an operation/display control unit 304 for controlling an operation unit and a display unit, and a sheet feed control unit 305 for controlling a sheet feed unit. The sequence control unit 307 controls the respective units 301 to 305, several detecting units (detector 306), and the like. The control unit 31 for the reversal sheet feeding device is composed of a drive unit 312 for the power sources such as the motor and the solenoid, several detectors 311, and the like, and operates in response to a signal from the sheet reversal control unit 308. In addition, the control unit 30 for the printing apparatus body is provided with a connection detector 309 for detecting whether the reversal sheet feeding device 26 is connected.

The operation of the double-surface printing apparatus roughly constituted as described above will be described hereinafter.

Upon receipt of a printing start signal from the host shown in FIG. 3, the charger 8 uniformly charges the photosensitive belt 22. The optical unit 5 makes a latent image on the photosensitive belt 22 in accordance with the printing data transmitted from the host. The latent image thus made is developed by either one of the developers 1 to 4 for black, cyan, magenta, and yellow, and colored particles in the developer are applied onto the photosensitive belt 22. The photosensitive belt 22 is rotated by a drive source (not shown), and transfers to the transfer drum 21 the colored particles on the photosensitive belt 22. Electric charge on the photosensitive belt 22 is removed by an erase lamp 160, and surplus colored particles remaining on the photosensitive belt 22 are removed therefrom by a cleaner 23, the photosensitive belt being again charged by the charger 8. In the case of color printing, the developers 1 to 4 are switched over to repeat the process several times. A visible image with monochromatic or multicolored particles is formed on the transfer drum 21, and at or before the completion of desired transfer, a sheet 27 is drawn from the first sheet feed cassette 6 or the second sheet feed cassette 7 by a first sheet feed roller 10 or a second sheet feed roller 24 to be on standby at the resist rollers 12.

Meanwhile, a predetermined period of time after a detector 161 detects the sheet 27, the first sheet feed roller 10 or the second sheet feed roller 24 stops, the timing when the position of the visualized image formed on the transfer drum 21 matches the transfer position onto the sheet 27 is watched, the sheet 27 on standby in the resist rollers 12 again starts to be conveyed, and the visualized image is transferred onto the sheet 27 by the transfer roller 13. Subsequently, the sheet 27 is peeled from the transfer drum 21 by the electricity eraser 15, and the colored particles are fixed onto the sheet 27 by the fixing unit 19.

In the case of performing printing on only one surface, a switching unit 17 does not operate, and the sheet 27 is discharged to a side of the paper discharge tray 28. In the case of double-surface printing, a solenoid 171 operates, the switching unit 17 comes down in FIG. 1 to take the sheet 27 into the reversal sheet feeding device 26 as shown in FIG.

Figure 6:
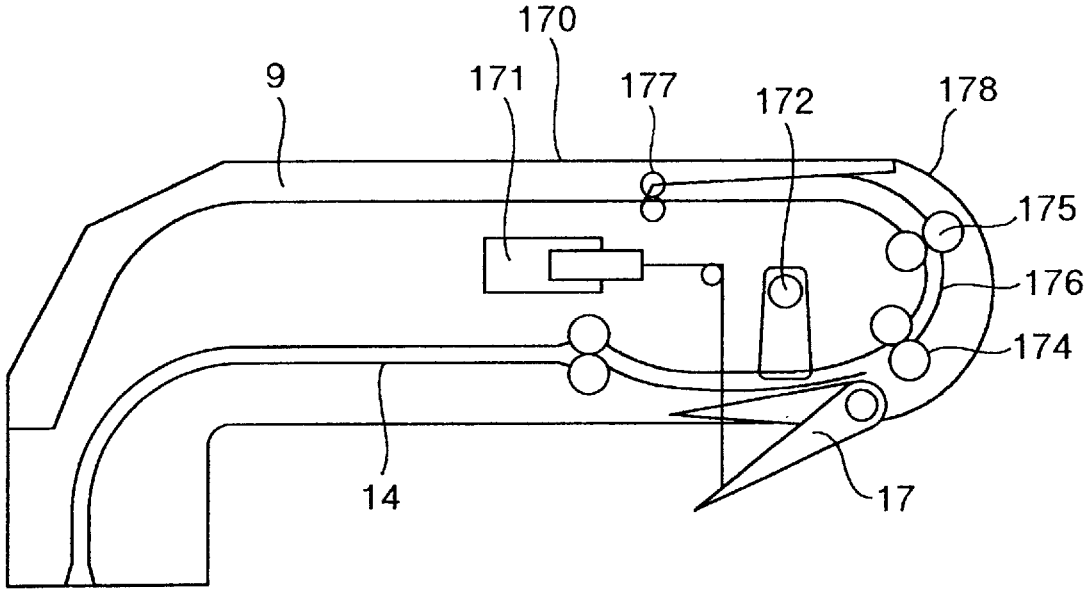
FIG. 6 is an enlarged view showing in details a sheet reversing section of the embodiment.

2, and the sheet 27 is conveyed to the reversal/temporary storage unit 9 disposed above the discharge section of the printing apparatus body 25 by a sheet guide 176, and conveying rollers 174, 175, 177 as shown in details in FIG. 6. In this case, since the conveying guide 176 mounted in the reversal/temporary storage unit 9 is formed to define a curved path having a curvature in an opposite direction to the curvature imparted to the sheet 27 by the fixing unit 19, curl assumed by the sheet 27, of which a first surface is subjected to printing, is corrected by virtue of the sheet being conducted to the curved path.

Figure 4:
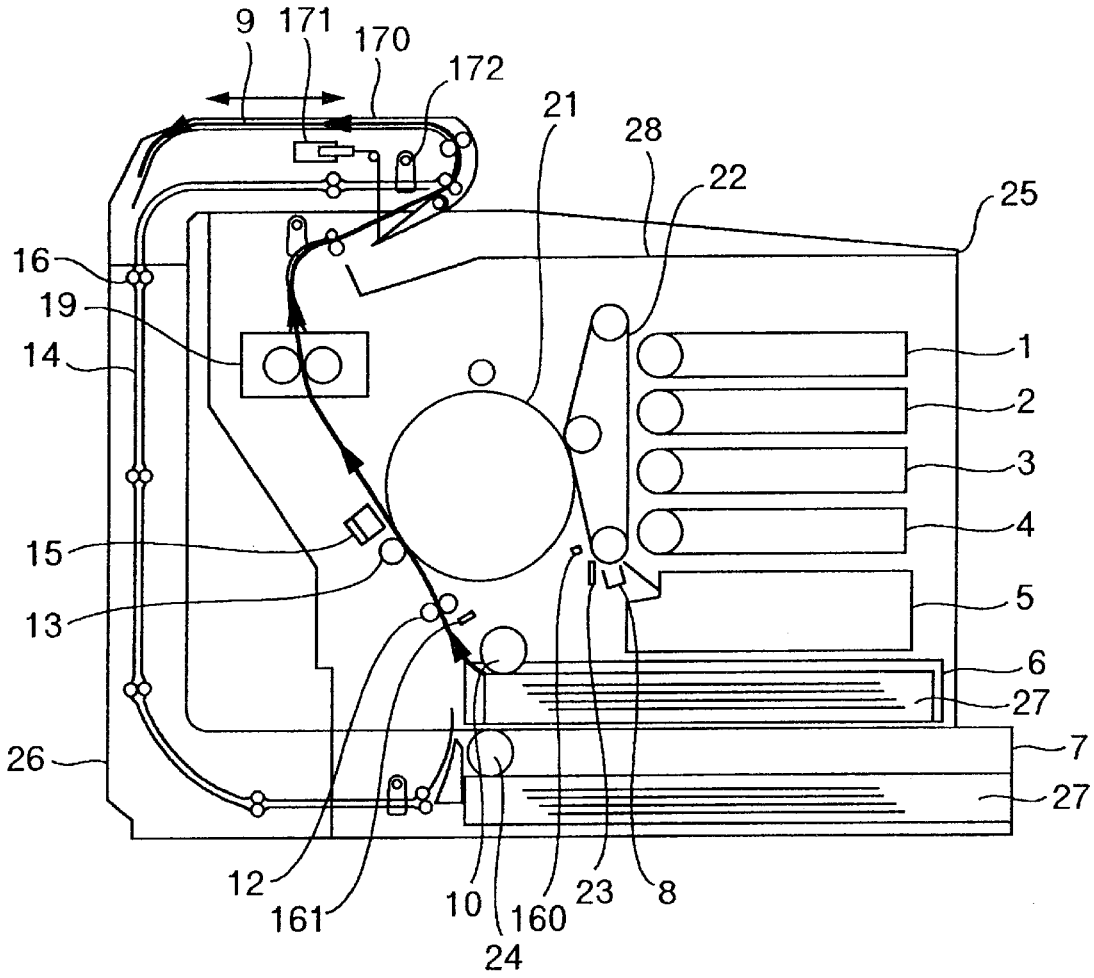
FIG. 4 is a view illustrating a condition, in which a sheet is conveyed to the reversal sheet feeding device in the double-surface printing apparatus according to the embodiment.

A first sheet detector 172 detects a trailing end of the sheet 27 having entered the reversal/temporary storage unit 9, thus terminating conveyance of the sheet 27 to the reversal/temporary storage unit 9. Alternatively, conveyance of the sheet 27 may be terminated by counting a period of time elapsed after the trailing end of the sheet 27 with the first surface thereof printed leaves a discharge sheet detector 173 mounted on the printing apparatus body 25. Shown by arrows in FIG. 4 is a condition of the sheet 27 conveyed from the first sheet feed cassette 6 to the reversal/temporary storage unit 9.

Figure 5:
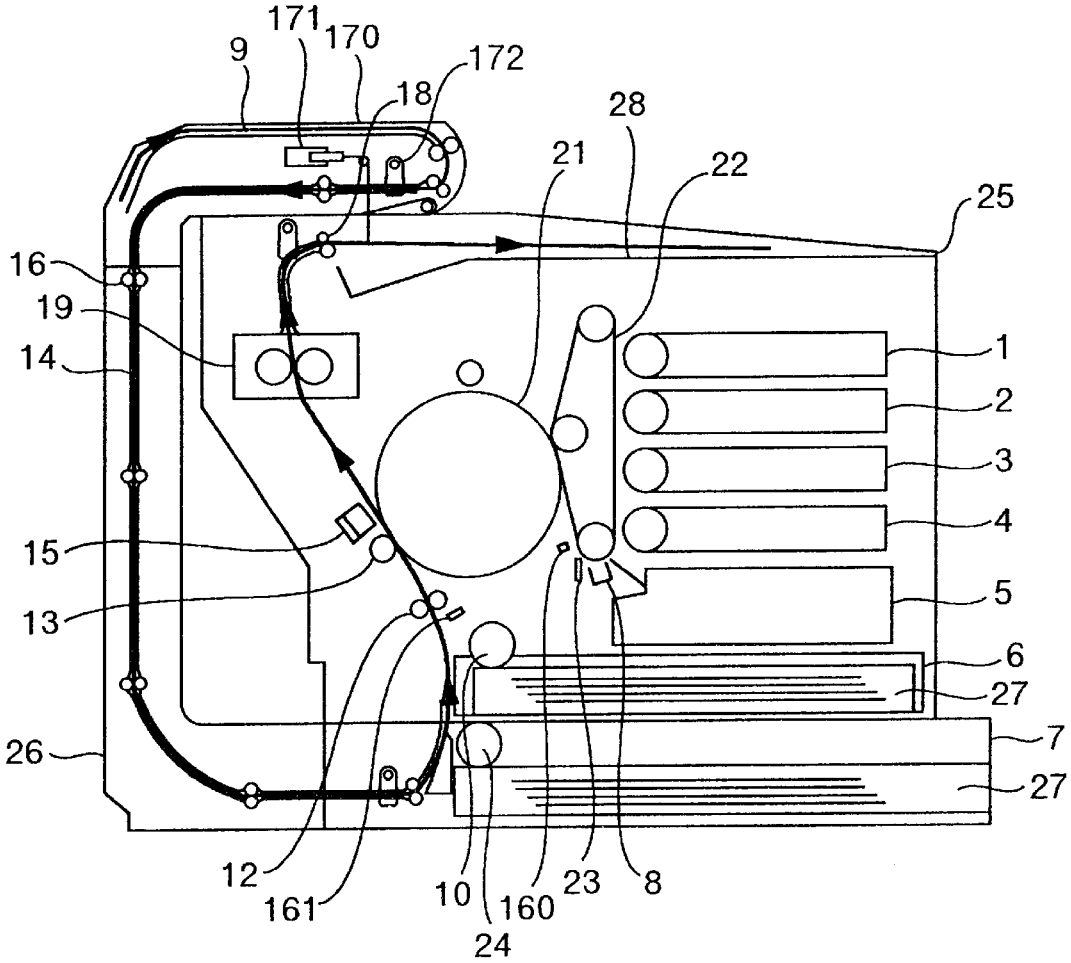
FIG. 5 is an explanatory view showing the sheet conveying state when the other surface from the reversal sheet feeding device is printed in the double-surface printing apparatus according to the embodiment.

The sheet 27 received in the reversal/temporary storage unit 9 is stopped in a state of being interposed by the nip of the conveying roller pairs 174, 175, 177, and switched back from the position for transfer on a second surface (back surface). More specifically, the drive control unit 303 issues a drive command to a motor (not shown) to reverse the conveying roller pairs 174, 175, 177, so that the sheet is taken out from the reversal/temporary storage unit 9 to be conveyed when the conveyance path is switched over to the sheet guide 14 by the first switching unit 17. Thus, the sheet 27 is made to pass through the conveyance path, which is defined by the sheet guide 14 and conveying rollers 16 in the reversal sheet feeding device 26 provided outside the printing apparatus body 25, and is again conveyed into the printing apparatus body 25 to be retained in the position of the resist rollers 12. At this time, the sheet is reversed by the above-described switching-back, so that the second surface (back surface) of the sheet faces the transfer drum 21. Printing data for the second surface (back surface) is fed from the host while the sheet 27 with the first surface (front surface) having been subjected to printing is being conveyed, or after the sheet is received in the reversal/temporary storage unit 9, and thus a visible image is formed on the transfer drum 21 in the above-described process. Subsequently, in a timing that a position of the visible image formed on the transfer drum 21 registers with a transfer position on the sheet 27, the sheet 27 having been on standby around the resist rollers 12 begins to be conveyed, and the visible image is transferred to the back surface of the sheet 27 by the transfer roller 13. Then, the sheet 27 is peeled off the transfer drum 21 by the electricity eraser 15, and colored particles are also fixed onto the sheet back surface by the fixing unit 19. The switching unit 17 operates to discharge the sheet 27 to the paper discharge tray 28, and the sheet 27 with both surfaces having been subjected to printing is discharged onto the paper discharge tray 28. A condition of the sheet being conveyed at this time is shown in FIG. 5. In FIG. 5 a path shown by arrows indicates a condition of the sheet 27 conveyed from the reversal/temporary storage unit 9 to the paper discharge tray 28.

FIG. 6 is a view showing in details a sheet reversing unit 178. The sheet 27 conveyed to the sheet reversing unit 178 by the switching unit 17 is conveyed to the reversal/temporary storage unit 9 by the pair of first conveying rollers 174, the sheet guide 176, the pair of second conveying rollers 175 and the third conveying roller pair 177. When conveyed to the sheet reversing unit 178, the sheet is conveyed while being interposed by the nip of the pair of first conveying rollers 174, the pair of second conveying rollers 175 and the pair of third conveying rollers 177. At this time, rotational speeds of the conveying roller pairs 177, 175 are controlled so that the peripheral speed of the pair of third conveying rollers 177 is higher than that of the pair of second conveying rollers 175. Therefore, tension acts on the sheet 27 to enable bending the sheet in a direction opposite to the curved direction of curl, which the fixing unit 19 of the printing apparatus body 25 has had the sheet assuming, whereby it becomes possible to remove curl of the sheet 27.

Figure 7:
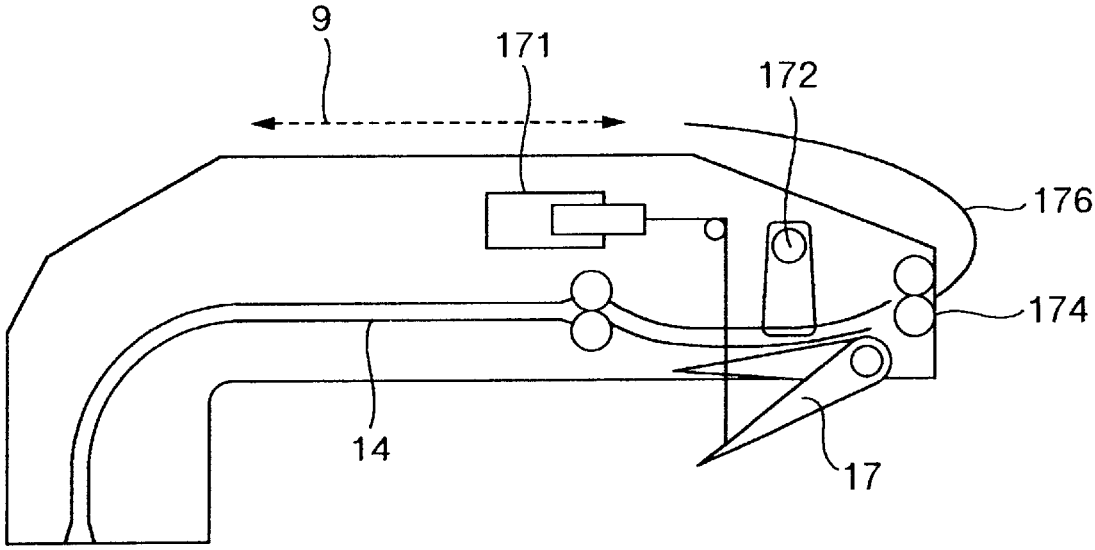
FIG. 7 is an enlarged view showing in details a sheet reversing section of the reversal sheet feeding device according to another embodiment of the invention.

FIG. 7 is a schematic view showing another embodiment of the sheet reversing unit 178. In this embodiment, a sheet guide 176 for guiding a sheet to the reversal/temporary storage unit 9 is provided downstream of the pair of first conveying rollers 174 in the conveying direction, and the sheet guide 176 is provided only in an area where the sheet 27 is bent and guided. The sheet 27 coming out of the pair of first conveying rollers 174 is fed along the sheet guide 176 to the reversal/temporary storage unit 9 disposed above the sheet reversing unit 178. In the embodiment, while there is not provided any member corresponding to the protective cover 170, the sheet 27 is conveyed getting clear of the surface of the paper discharge tray 28 by the sheet guide 176, so that the sheet is judged to be still in the course of printing, and the sheet can be prevented from being taken out by mistake in the course of printing. However, the sheet 27 is conveyed only by the conveying force of the pair of conveying rollers 174, so that it is not possible to remove curl of the sheet, which is imparted by the fixing unit 19 of the printing apparatus body 25.

What is claimed is:

1. A double-surface printing apparatus comprising a paper discharge tray, to which sheets having been subjected to printing are discharged; a sheet reversing mechanism including a reversal/temporary storage unit for guiding a sheet in a direction different from a discharge direction toward said paper discharge tray, once exposing the sheet outside of the apparatus, and rotating conveying rollers in an opposite direction to thereby reverse the sheet; and a protector, which covers the sheet conveyed to the reversal/temporary storage unit; wherein directions, in which a sheet is guided toward the reversal/temporary storage unit and toward the paper discharge tray, are set to be opposite to each other; and wherein the reversal/temporary storage unit is provided on a top of the apparatus, and protective means is provided which comprises a protective cover covering the entire region of the reversal/temporary storage unit.

2. A double-surface printing apparatus comprising a paper discharge tray, to which sheets having been subjected to printing are discharged; a sheet reversing mechanism including a reversal/temporary storage unit for guiding a sheet in a direction different from a discharge direction toward said paper discharge tray, once exposing the sheet outside of the apparatus, and rotating conveying rollers in an opposite direction to thereby reverse the sheet; and a protector, which covers the sheet conveyed to the reversal/temporary storage unit;

wherein directions, in which a sheet is guided toward the reversal/temporary storage unit and toward the paper discharge tray, are set to be opposite to each other; and wherein the reversal/temporary storage unit is provided on a top of the apparatus, and protective means is provided which comprises a sheet guide covering a curved path portion of the reversal/temporary storage unit.

3. A double-surface printing apparatus comprising a paper discharge tray, to which sheets having been subjected to printing are discharged; a sheet reversing mechanism including a reversal/temporary storage unit for guiding a sheet in a direction different from a discharge direction toward said paper discharge tray, once exposing the sheet outside of the apparatus, rotating conveying rollers in an opposite direction to thereby reverse the sheet; and a protector, which covers the sheet conveyed to the reversal/temporary storage unit; and curl removing means provided in the sheet reversing mechanism for correcting a curl applied to a sheet during a printing process; wherein the curl removing means comprises conveying rollers and the reversal/temporary storage unit provided in the sheet reversing mechanism; wherein the reversal/temporary storage unit includes a curved portion formed to have a curvature opposite to that of a direction, in which a sheet is curled, and the conveying rollers include at least a pair of first conveying rollers provided in the curved portion, and a pair of second conveying rollers positioned downstream of the pair of first conveying rollers at the time of entry of a sheet, and wherein a peripheral speed of the pair of second conveying rollers is set to be higher than that of the pair of first conveying rollers.

* * * * *